US005593162A

United States Patent [19]

Minuskin

[11] Patent Number: 5,593,162

[45] Date of Patent: Jan. 14, 1997

[54] TARGET DEVICE

[76] Inventor: Steven E. Minuskin, 30 Bevshire Circle, Thornhill, Ontario, Canada

[21] Appl. No.: 461,905

[22] Filed: Jun. 5, 1995

[51] Int. Cl.[6] ..... F41J 1/00

[52] U.S. Cl. ..... 273/403; 273/407; 273/409

[58] Field of Search ..... 273/403, 404, 273/408, 409, 407, 348, 378; 2/206

[56] References Cited

U.S. PATENT DOCUMENTS 2,262,992 11/1941 Dessart ..... 2/206
4,203,600 5/1980 Brown ..... 273/407

*Primary Examiner*—William H. Grieb
*Attorney, Agent, or Firm*—Kenneth M. Garrett

[57] ABSTRACT

A target suitable for gun practise comprises a hollow shell defining a concavity within which is disposed a score sheet in three dimensions. The shell is preferably completely open at the back thereof and the score sheet is preferably a planar sheet which is arched for insertion through the open back.

15 Claims, 2 Drawing Sheets

TARGET DEVICE

FIELD OF INVENTION

This invention relates to a target for use in shooting, particularly with firearms, although it is not necessarily restricted thereto. It further relates to reusable targets which are of a three dimensional nature and which are adapted for use with a replaceable marking member.

BACKGROUND OF INVENTION

It is well known in target practice shooting to use planar targets which may be shaped or have indicia thereon to represent an object including a life-form object serving as a target. For military and police training it is not unusual that the object have a human life-form. The planar targets are commonly of a replaceable nature and may serve to mark each hit for scoring purposes. Normally the target will be set up so as to be substantially at fight angles to the intended trajectory.

It is also known to use re-usable three dimensional targets which are commonly of a foam plastic material to provide a more realistic representation of a life-form. Generally the rear surface of such targets is planar, and a planar marking member is secured to the rear surface for the purpose of marking hits. As is the case when the target itself is planar, the three dimensional target will usually be set-up so that the planar marking member is at fight angles to the intended trajectory. When the trajectory is not at right angles to the marking member, as may be the case with more advanced training, a body hit may not be recorded on the marking member. Also in advanced training, it is desirable to ascertain the likely effects of any hit on vital body organs, and the planar marking member disposed at the rear of the target will give unreliable results where the trajectory varies from a right angle.

In most instances a target will be oriented so as to present a maximum area of incidence to the shooter, and will be expected to be struck most frequently in medial portions thereof, leading to their disintegration over a period of time. There is no manner in which currently known three dimensional targets can be easily repaired. In addition, currently known three dimensional life-form targets are not nestable together, so as to facilitate shipping, storing and handling of the targets.

Targets may be used to simulate hostage taking situations wherein certain of the targets are designated for take-out, while others of the targets are designated as being protected. It would be desirable to provide a simple and inexpensive manner of differentiating targets for different situations.

It is an object of my invention to provide three dimensional reusable targets which can be used with a marking member for both simple and advanced firearms training.

It is another object of my invention to provide reusable three dimensional targets that are easily repairable by unskilled persons and that are stackable for storage and transportation purposes.

SUMMARY OF THE INVENTION

In accordance with one aspect of my invention, a target for firearms practise comprises a reusable body having a cavity therein into which a marking member is removably locatable. Suitably and preferably, where the reusable body is configured to represent a life-form, the cavity will encompass the position of one or more vital organs of that life form so as to permit the marking member to be oriented therein in a manner approximating the position of such vital organ or organs, at least in a peripheral manner. Accordingly, any hit recorded on the marking member will be more likely to be indicative of the possible effect that the hit would have produced on a vital organ of the life-form than if the marking member were to have been physically spaced apart from the position of such vital organ, as tends to be the case where the marking member is disposed in a plane at the rear of the life-form target.

Also suitably and preferably, the marking member will, at least when disposed within the cavity, extend in three dimensions; preferably also the marking member when not disposed in the cavity will have a flat, planar form. Suitably, the marking member will be provided with indicia thereon to facilitate scoring any hit that is marked on the marking member.

In accordance with another and preferred aspect of my invention, the body is defined by a thin shell which extends about the front and sides of the body, the back of which is completely open to the concavity of the shell. Such opening permits the placement of the marking member within the concavity in an arched formation extending across the front of the body and about the sides inwardly thereof, so as to approximate the outer most peripheral position of vital organs with the life-form represented by the target, and may also permit the nesting of targets for transportation and storage purposes.

The body may be formed from a plastic material having light transmitting properties through which the marking member is discernable. Accordingly, the marking members for use with the target may be provided in different colors to permit individual ones of groups of targets to be identified.

The above objects and advantages of my invention together with other aims, objects and advantages will be described in relationship to the preferred embodiment of my invention, with reference to the drawings annexed hereto wherein.

DESCRIPTION OF THE PREFERRED EMBODIMENT

Figure 1:
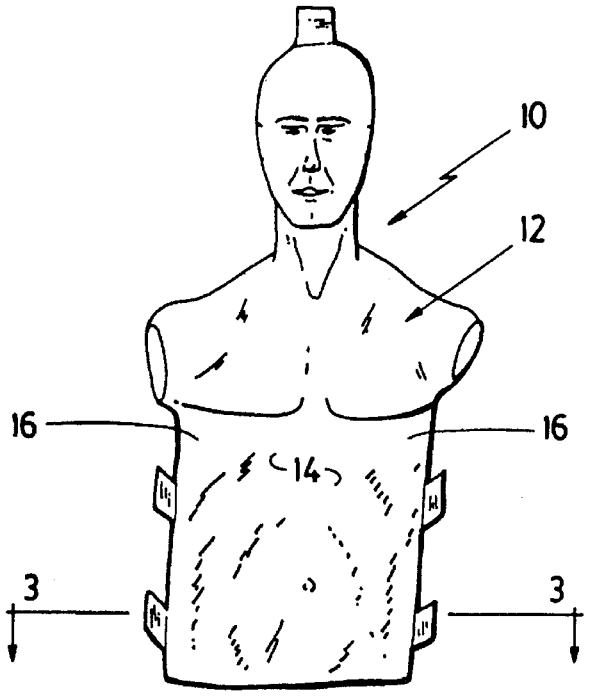
FIG. 1 shows a target configured as a human form in front elevational view.
Figure 2:
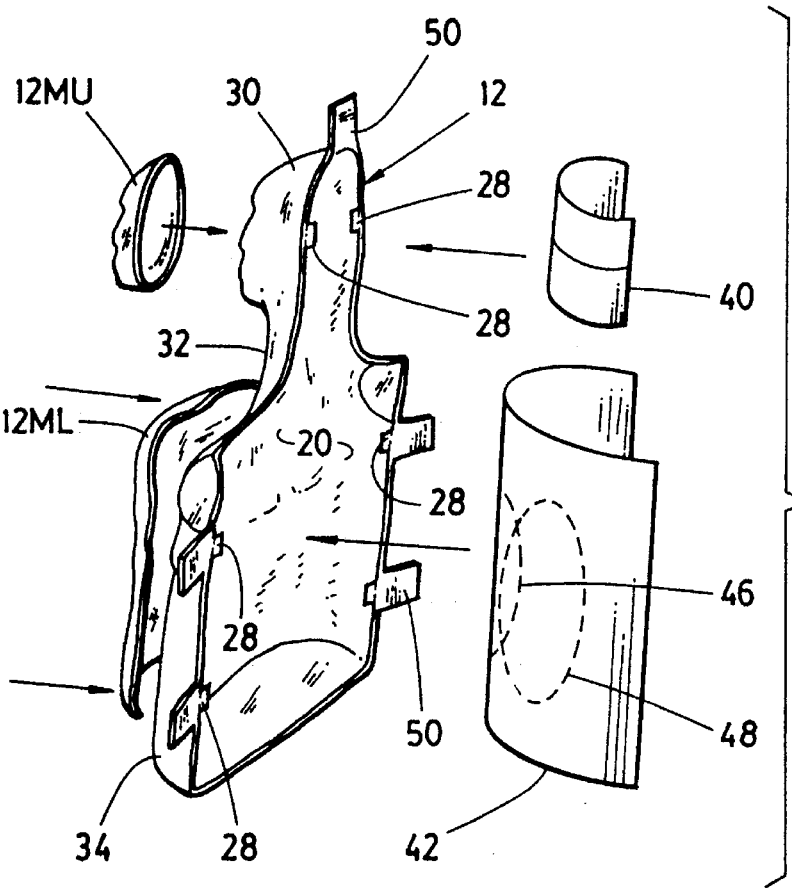
FIG. 2 shows the target of FIG. 1 in side, rear perspective view with a marking member positioned for insertion therein, together with medial portions positioned in a manner for effecting the repair of the target.
Figure 3:
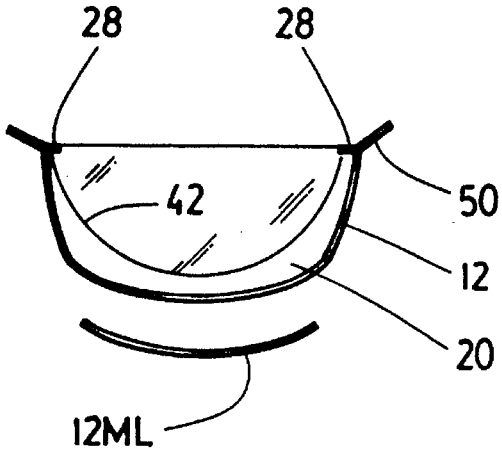
FIG. 3 is a section on line 3—3 of FIG. 1, together with a nestable medial section which may be used for repair purposes.

Referring to the drawings in detail, a target in accordance with my invention is identified generally therein by the numeral 10. Target 10 comprises a thin walled shell 12 with front 14 and sides 16, the sides terminating along a rim 18 generally in a plane which defines the back of the shell, which is completely open into the concavity 20 of the shell. Within the concavity 20 adjacent to rim 18 there are secured to side 16 a plurality of clips 28 at vertically spaced apart intervals. Shell 12 is configured as a human form with a head portion 30, neck portion 32 and torso portion 34. A first marking member 40 in the form of a planar sheet of light card stock is disposed in concavity 20, and is held in a forwardly arched formation within head portion 30 and neck portion 32 by clips 28 in the head portion. A second somewhat larger marking member 42 is disposed in concavity 20 in the torso portion 34 thereof, also held in a forwardly arched formation by clips 28 in that portion. Marking member 42 has indicia 44 thereon to define a first area 46 and a part of second areas 48 in overlapping relationship with the first area. Area 46 will generally demark the peripheral limit of vital organs contained within torso portion 34 when marking member 42 is disposed in the torso portion in the above described manner and the target is viewed from the front, whereas the second areas 48 will demark the peripheral limits of the vital organs when the target 10 is viewed from the side. Marking member 40 has indicia 44 there on which will define the approximate lower limit of the brain area of the life form represented by the target.

Figure 4:
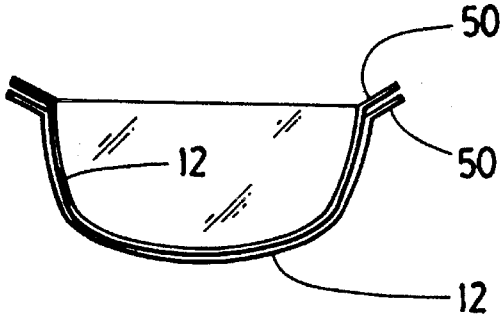
FIG. 4 shows a section taken at a similar position to that of FIG. 3 through several nested targets.

Shell 12 is conveniently made from pre-formed plastic sheet material by vacuum forming or like technique, with a one shell being nestable within another shell, as best seen in FIG. 4, for transportation purposes. Medial portions 12MU and 12ML are nestable over similar medial portions of target 10, and may be an adhered thereto in order to repair structural damage to the target that arises in the course of its use.

Figure 5A:
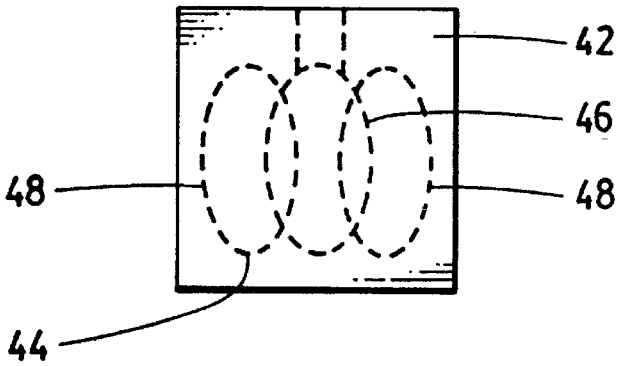
FIG. 5A shows a first marking member in planar form for use with the target of FIG. 1.
Figure 5B:
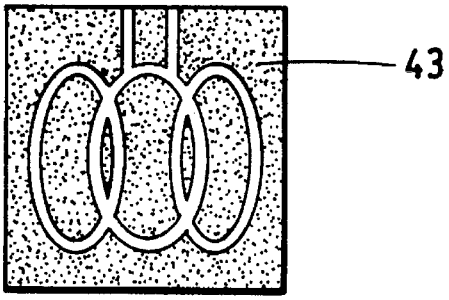
FIG. 5B shows a second marking member similar to that shown in FIG. 5A but lined to show a different surface color.

Suitably and preferably, shell 12 is formed from a light transmitting material, preferably being translucent with a neutral white or lightly tinted shade. Accordingly a marking member 43 having a darker surface coloring thereon, as seen in FIG. 5B, will when inserted within cavity 20 impart a coloration to target 10, so that different targets may be differentiated by differently colored marking members.

The manufacture of shell 12 by vacuum forming or the like technique will leave a flange circumscribing rim 18; suitably such flange is in part removed to leave a plurality of tabs 50 unitary with shell 12 for securing target 10 to support forms such as are commonly used for target practise, or for suspending target 10 from a target hanger.

In use, target 10 will commonly most frequently be oriented so as to present a maximum frontal aspect, and in this instance first area 46 of indicia 44 will serve to delimit the area of maximum effectiveness of any hit with reasonable accuracy. Target 10 may also be oriented to present a minimum aspect i.e. as seen from the side, in which instance second areas 48 will delimit the maximum area of effectiveness of hits, with adjustments being made for the trajectory as may be gauged from a comparison of entry openings and exit openings made in marking member 42. It will be appreciated that more complex forms of indicia, for example in the form of a grid pattern, can be employed to facilitate accurate scoring. It will also be appreciated that other forms of three dimensionally arranged marking members that are more or less complex than the simple marking members 40, 42 described above may be employed.

I claim:

1. A shooting target suitable for gun training comprising a hollow three dimensional body defining a cavity therein for removably locating a marking member;

a marking member disposed to extend in three dimensions within said cavity;

wherein said target is formed from a material having light transmitting properties and wherein said marking member has a surface coloration visible through said target.

2. A shooting target as defined in claim 1 wherein said target is configured as a life form and wherein said cavity encompasses the position of one or more vital organs within the life form represented.

3. A combination as defined in claim 2 wherein said marking member is a planar sheet in arched form.

4. A combination as defined in claim 2 wherein said marking member is provided with indicia whereon representative of one or more vital organs of said life form represented.

5. A combination as defined in claim 2 wherein said marking member is releasably retained in said cavity in a predetermined spatial relationship therewith by a plurality of clips disposed within said cavity.

6. A shooting target as defined in claim 2 wherein at least medial portions of said body are nestable to permit the repair of medial portions by covering with identical preformed medial portions.

7. A shooting target as defined in claim 2 wherein said body is nestable within an identical such body for storage purposes.

8. A shooting target comprising a three dimensional body configured as a life form defined by a thin concave shell extending about the front and sides of said body, wherein the back of said body is completely open, to permit a marking member to be disposed within the concavity of said body; a plurality of clips disposed within said shell adjacent the back thereof for releasably retaining said marking member within said concavity; and a marking member releasably retained within said cavity by said clips.

9. A combination as defined in claim 8 wherein said marking member is a two dimensional sheet arranged within said cavity to extend across the front and sides thereof in predetermined spatial relationship therewith.

10. A combination as defined in claim 9 wherein marking member has indicia therein to facilitate scoring of any hits marked therein.

11. A shooting target as defined in claim 8 including a plurality of target mounting tabs unitarily formed with said body.

12. A shooting target as defined in claim 8 wherein said body is configured whereby at least a major medial portion thereof is nestable with an identical medial portion to permit a pre-formed such medial portion to be secured in overlaying relationship with an underlying portion of said target for the repair thereof.

13. A shooting target as defined in claim 12 wherein said body as a whole is configured to be nestable within an adjacent said body.

14. A shooting target as defined in claim 8 wherein said shell comprises a material having light transmitting properties through which a marking member having a contrasting color will be visible when disposed within said cavity.

15. A shooting target comprising a three dimensional body configured as a life form defined by a thin concave shell extending about the front and sides of said body wherein the back of said body is completely open to permit a marking member to be disposed within the concavity of said body;

a target member arcuately disposed within said body;

and a plurality of target mounting tabs unitarily formed with said body.

* * * * *